US007163133B2

(12) United States Patent
Woody et al.

(10) Patent No.: US 7,163,133 B2
(45) Date of Patent: Jan. 16, 2007

(54) APPARATUS FOR AND METHOD OF MOVING A SLIDER ALONG MATING ZIPPER ELEMENTS

(75) Inventors: Clark Woody, Pinconning, MI (US); Jeffrey S. Hoffman, Linwood, MI (US); Philip G. Velez, Saginaw, MI (US); Bryan L. Ackerman, Freeland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 391 days.

(21) Appl. No.: 10/794,857

(22) Filed: Mar. 5, 2004

(65) Prior Publication Data

US 2005/0194417 A1 Sep. 8, 2005

(51) Int. Cl.
*B65H 20/00* (2006.01)
*B65H 20/24* (2006.01)

(52) U.S. Cl. ..... 226/190; 226/193; 226/111; 226/158

(58) Field of Classification Search ..... 226/190, 226/193, 194, 111, 158, 163, 165; 29/408, 29/453, 400, 768; 493/394, 927
See application file for complete search history.

(56) References Cited

U.S. PATENT DOCUMENTS

| | | | | |
|---|---|---|---|---|
| 3,116,544 | A | 1/1964 | Fisher | 29/208 |
| 3,127,670 | A | 4/1964 | Bruning | 29/408 |
| 3,256,012 | A | 6/1966 | Bradley | 271/74 |
| 3,426,396 | A | 2/1969 | Laguerre | 24/201 |
| 3,607,534 | A | 9/1971 | Gutman | 156/269 |
| 3,640,050 | A | 2/1972 | Nystrand et al. | 53/120 |
| 3,701,191 | A | 10/1972 | Laguerre | 29/207.5 |
| 3,701,192 | A | 10/1972 | Laguerre | 29/207.5 |
| 3,840,050 | A | 10/1974 | Eggenberger | 137/627.5 |
| 3,854,031 | A * | 12/1974 | Keller | 219/244 |
| 4,262,395 | A | 4/1981 | Kosky | 24/201 |
| 4,522,678 | A | 6/1985 | Zieke | 156/501 |
| 4,555,282 | A | 11/1985 | Yano | 156/66 |
| 4,581,006 | A * | 4/1986 | Hugues et al. | 493/213 |
| 4,588,070 | A | 5/1986 | Smith | 198/468.3 |
| 4,919,415 | A | 4/1990 | Smith et al. | 271/284 |
| 5,067,208 | A | 11/1991 | Herrington et al. | 24/400 |
| 5,088,971 | A | 2/1992 | Herrington | 493/203 |

(Continued)

FOREIGN PATENT DOCUMENTS

| | | | |
|---|---|---|---|
| EP | 0 339 324 | 11/1989 | 33/25 |

(Continued)

*Primary Examiner*—Emmanuel Marcelo
*Assistant Examiner*—Evan H. Langdon

(57) ABSTRACT

A manufacturing apparatus, for moving sliders for opening and closing mating zipper elements along the mating zipper elements, includes a roller and a projection. The roller rotates about an axis substantially perpendicular with a path of a film including the mating zipper elements and contacts the film as the film moves in the film path at a speed equal to the speed of rotation of the roller. The projection rotates about an axis at a speed different than the rotational speed of the roller, with the projection rotating into proximity to the moving film along predetermined lengths of the film so as to be contactable with sliders mounted thereon. The projection comes into contact with sliders positioned along the mating zipper elements of the predetermined lengths of film and pushes those sliders along the mating zipper elements to respective registered positions.

14 Claims, 5 Drawing Sheets

U.S. PATENT DOCUMENTS

| | | | | |
|---|---|---|---|---|
| 5,283,932 | A | 2/1994 | Richardson et al. | 24/400 |
| 5,405,478 | A | 4/1995 | Richardson et al. | 156/308.4 |
| 5,816,018 | A | 10/1998 | Bois | 53/133.4 |
| 5,826,401 | A | 10/1998 | Bois | 53/412 |
| 5,827,163 | A | 10/1998 | Kettner | 493/211 |
| 5,833,791 | A | 11/1998 | Bryniarski et al. | 156/244.25 |
| 5,857,310 | A | 1/1999 | Bois | 53/373.6 |
| 5,884,452 | A | 3/1999 | Bois | 53/412 |
| 6,032,437 | A | 3/2000 | Bois | 53/412 |
| 6,085,491 | A | 7/2000 | Bois | 53/412 |
| 6,088,887 | A | 7/2000 | Bois | 24/399 |
| 6,131,374 | A | 10/2000 | Bois | 53/451 |
| 6,161,271 | A * | 12/2000 | Schreiter | 29/408 |
| 6,213,640 | B1 | 4/2001 | Bois | 383/25 |
| 6,220,754 | B1 | 4/2001 | Stiglic et al. | 383/64 |
| 6,261,000 | B1 | 7/2001 | Bois | 383/120 |
| 6,287,001 | B1 | 9/2001 | Buchman | 383/64 |
| 6,305,844 | B1 | 10/2001 | Bois | 383/64 |
| D451,378 | S | 12/2001 | Kinigakis et al. | D9/305 |
| 6,334,709 | B1 | 1/2002 | Bois | 383/37 |
| 6,357,914 | B1 | 3/2002 | Kinigakis et al. | 383/64 |
| 6,599,227 | B1 * | 7/2003 | Kettner | 493/394 |
| 6,713,152 | B1 | 3/2004 | Chen et al. | 428/99 |
| 6,770,018 | B1 * | 8/2004 | Tomic | 493/325 |
| 2004/0050017 | A1 | 3/2004 | Thomas et al. | 53/412 |
| 2004/0055255 | A1 | 3/2004 | Knight et al. | 53/412 |
| 2004/0066985 | A1 | 4/2004 | Patel et al. | 383/64 |
| 2004/0066986 | A1 | 4/2004 | Erlick et al. | 383/64 |
| 2004/0081375 | A1 | 4/2004 | Pokusa | 383/64 |

FOREIGN PATENT DOCUMENTS

| | | | |
|---|---|---|---|
| EP | 0 371 402 | 6/1990 | 19/16 |
| EP | 0 633 187 | 1/1995 | 9/20 |
| EP | 0 667 288 | 8/1995 | 61/18 |
| EP | 0 689 993 | 1/1996 | 9/20 |
| EP | 0 691 266 | 1/1996 | 9/20 |
| EP | 0 775 633 | 5/1997 | 9/20 |
| EP | 0 792 801 | 9/1997 | 9/20 |
| EP | 0 792 802 | 9/1997 | 9/20 |
| EP | 0 855 346 | 7/1998 | 33/25 |
| EP | 0 888 973 | 1/1999 | 33/22 |
| EP | 0 906 866 | 4/1999 | 9/20 |
| EP | 0 908 392 | 4/1999 | 33/16 |
| EP | 0 910 539 | 4/1999 | 33/25 |
| EP | 0 912 327 | 5/1999 | 19/36 |
| EP | 0 915 019 | 5/1999 | 61/18 |
| EP | 0 918 688 | 6/1999 | 9/20 |
| EP | 0 925 229 | 6/1999 | 33/25 |
| EP | 0 938 427 | 9/1999 | |
| EP | 0 980 333 | 2/2000 | 33/14 |
| EP | 0 944 772 | 4/2000 | 19/90 |
| EP | 0 998 413 | 5/2000 | |
| EP | 1 000 559 | 5/2000 | 19/26 |
| EP | 1 003 395 | 5/2000 | 19/26 |
| EP | 1 013 401 | 6/2000 | 47/4 |
| EP | 1 038 774 | 9/2000 | 9/20 |
| EP | 1 091 883 | 4/2001 | 33/25 |
| EP | 1 094 932 | 5/2001 | 19/90 |
| EP | 1 106 337 | 6/2001 | 19/90 |
| EP | 1 107 863 | 6/2001 | 19/90 |
| EP | 1 140 481 | 10/2001 | 19/60 |
| EP | 1 169 934 | 1/2002 | 19/26 |
| GB | 2 120 999 | 12/1983 | 30/10 |
| WO | WO 98/02354 | 1/1998 | 9/20 |
| WO | WO 98/32593 | 7/1998 | 19/36 |
| WO | WO 98/45182 | 10/1998 | 33/25 |
| WO | WO 98/50277 | 11/1998 | 33/14 |
| WO | WO 98/57863 | 12/1998 | 33/25 |
| WO | WO 99/24322 | 5/1999 | |
| WO | WO 99/36325 | 7/1999 | 33/25 |
| WO | WO 99/56947 | 11/1999 | 19/90 |
| WO | WO 99/62780 | 12/1999 | |
| WO | WO 99/65353 | 12/1999 | 19/16 |
| WO | WO 00/02722 | 1/2000 | 19/90 |
| WO | WO 00/37246 | 6/2000 | 19/90 |
| WO | WO 00/64765 | 11/2000 | 33/25 |
| WO | WO 01/02162 | 1/2001 | 19/90 |

* cited by examiner

APPARATUS FOR AND METHOD OF MOVING A SLIDER ALONG MATING ZIPPER ELEMENTS

BACKGROUND

1. Technical Field

The field of the present invention relates generally to an apparatus for and a method of moving a slider for operating mating zipper elements along the mating zipper elements during the manufacture of a product that includes mating zipper elements operated by a slider.

2. Background Art

The manufacture of thermoplastic bags and other products containing mating zipper elements (i.e., a thermoplastic zipper typically having a rib and groove construction) is known in the art. Often, such mating zipper elements are operated by a slider. There are a wide variety of designs for such slider-zipper combinations. For example, U.S. Pat. Nos. 5,067,208; 4,262,395 and 5,283,932 show different types of sliders and mating zipper elements used in the construction of re-sealable thermoplastic bags. In these and other known arrangements, the sliders operate to connect and disconnect (depending on the direction of movement) opposing mating zipper elements as the slider is moved along the length of the zipper by a user. Thus, by moving the slider, the user can open or close the re-sealable thermoplastic bag or other such product.

In the manufacture of such thermoplastic bags, for example, a web of folded thermoplastic film is used to form a series of bags. Formed on ends of the folded thermoplastic film opposite the fold are corresponding mating zipper elements. As the film is fed through different stages in the manufacturing process in the direction of the fold, various assemblies perform tasks such as mounting the sliders on the zippers corresponding to separate bags, severing and sealing the film to form the lateral edges of the separate bags, and fusing specified lengths of the mating zipper elements to form the ends thereof. In a typical manufacturing process, the thermoplastic film is indexed to different stages in which individual components perform the different manufacturing processes described above.

Typically, the manufacturing system is set up such that the slider is properly positioned on the mating zipper elements as the film is fed through the system and processed in the different stages. However, it is possible that the slider may be mechanically forced out of position along the mating zipper elements during the manufacturing process.

Also, the slider could become out of position with respect to the manufacturing line. For instance, the film may be mis-fed or stretched due to a build up of tension in the film. Thus, while the slider may not move out of position along the mating zipper elements, the slider may be out of position with respect to the components or stages of the manufacturing line.

When mis-positioned, the slider has the potential of interfering with components of the manufacturing system. The interference can lead to damage to the slider, which would make the final product defective. However, when the slider is mis-positioned due to tension that stretches the film, the final product may be defective anyway because the film itself may not be properly processed.

Nevertheless, it is still important that the slider not be mis-positioned even when the end product will be defective. The reason being that the slider is typically made of a rigid plastic material that can damage or jam components of the manufacturing line if it interferes with the operation of those components.

For example, in one stage of manufacturing re-sealable thermoplastic bags including a slider-zipper combination, a folded web of thermoplastic film is laterally severed and sealed into segments which define the separate bags. As shown in FIG. 3, the typical mechanism for performing this process is a clamping device 200, which includes a pair of seal bars 30 separated by a gap, an electrically-heated hot wire 40, and a seal drum 20. The seal bars 30 intermittently contact the film and clamp it against the seal drum 20. Once clamped, the hot wire 40 advances through an opening in the surface of the seal drum 20, burns its way through the film, and moves into the gap between the seal bars 30. In this way, the film is severed into segments and the resulting severed edges are simultaneously sealed.

It is possible that the slider 50 may be mis-positioned with respect to the components for severing and sealing the film because the slider 50 is moved out of position along the mating zipper elements or because tension in the film causes stretching that mis-positions the entire film. In such an instance, the slider 50 may interfere with the operation of the components for severing and sealing the film, as shown in FIG. 3. In particular, the slider 50 may be clamped and crushed between a seal bar 30 and the seal drum 20, which can damage the hot wire 40, in addition to the slider 50 itself. Also, if the slider 50 is in the path of the hot wire 40, the hot wire 40 can be bent or snapped as it moves through the gap.

Accordingly, not only is it important to position the slider so it is not damaged by the machinery on the assembly line, but it is even more important to ensure that the slider is not in a position at which it can damage the machinery.

If the slider is accurately positioned with respect to the machinery and components of the manufacturing system, valuable time is saved by not having to shut down the system to repair damage that may be caused by the sliders. In addition, costs are reduced by increasing the life of the components that otherwise would need to be replaced because of slider damage.

Accordingly, there is a need in the art for a system for positioning the sliders along the mating zipper elements during the manufacture of products that include mating zipper elements operated by a slider, so as to not interfere with machinery used in the manufacturing process.

SUMMARY OF THE INVENTION

The present invention addresses the foregoing needs in the art by providing an apparatus for and a method of positioning sliders along mating zipper elements during the manufacture of products that include mating zipper elements operated by a slider. Most preferably, the present invention addresses the foregoing needs by providing an apparatus for and a method of clearing sliders from intermittent lengths of the mating zipper elements.

In a first aspect of the invention, a manufacturing apparatus, for moving sliders for opening and closing mating zipper elements along the mating zipper elements, includes a roller and a projection. The roller rotates about an axis substantially perpendicular with a path of a film including the mating zipper elements and contacts the film as the film moves in the film path at a speed equal to the speed of rotation of the roller. The projection rotates about an axis at a speed different than the rotational speed of the roller, with the projection rotating into proximity to the moving film along predetermined lengths of the film so as to be contactable with sliders mounted thereon. The projection comes into contact with sliders positioned along the mating zipper elements of the predetermined lengths of film and pushes those sliders along the mating zipper elements to respective registered positions.

In a preferred embodiment, the projection is mounted on a wheel that rotates about an axis substantially parallel with the axis of rotation of the roller, at a speed faster than the roller.

In another preferred embodiment, a portion of the projection is positioned within a depression on the roller that couples a slider as the film and slider move across the roller. The projection moves within the depression to contact and push the slider to the proper position.

In another aspect, the invention provides a method of moving sliders for opening and closing mating zipper elements along the mating zipper elements during the manufacture of products that include mating zipper elements operated by a slider. The method includes a step of supporting a film containing the mating zipper elements on a roller rotating about an axis substantially perpendicular with a path of the film as the film moves in the film path at a speed equal to the speed of rotation of the roller. The method also includes a step of intermittently moving a projection into proximity to the mating zipper elements along predetermined lengths of the mating zipper elements so as to be contactable with sliders mounted thereon. In addition, the method includes a step of pushing the sliders, which are positioned along the predetermined lengths of the mating zipper elements, with the projection along the mating zipper elements to respective registered positions.

In yet another aspect of the invention, an apparatus for positioning sliders mounted along a moving film includes supporting means for supporting the film in its path of movement. The apparatus also includes gaging means for gaging the rate of movement of the film in the path of movement. In addition, the apparatus includes pushing means for pushing sliders positioned along predetermined lengths of the film at regularly spaced intervals, to respective registered positions based on the rate of the film movement gaged by the gaging means.

A better understanding of these and other objects, features, and advantages of the present invention may be had by reference to the drawings and to the accompanying description, in which there are illustrated and described preferred embodiments of the invention.

DESCRIPTION OF THE PREFERRED EMBODIMENT(S)

Figure 1:
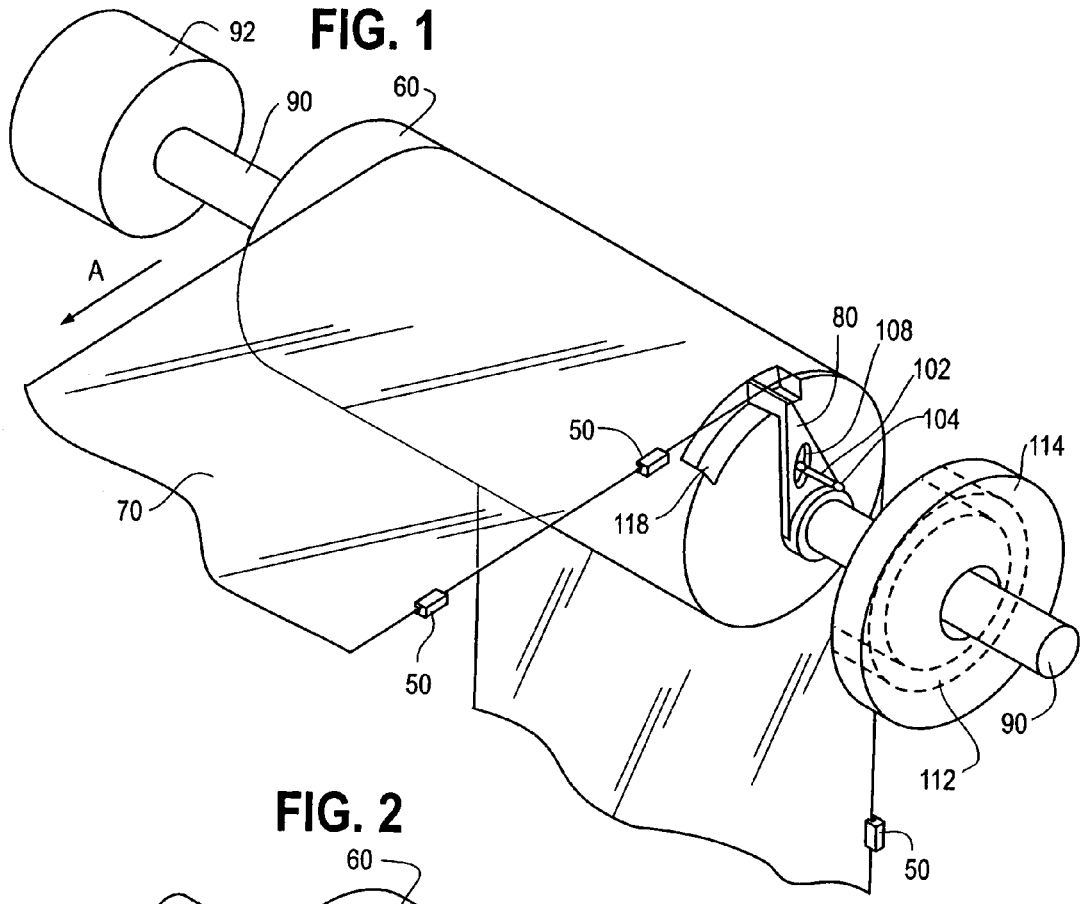
FIG. 1 is a perspective view of an apparatus according to a first embodiment of the present invention.
Figure 2:
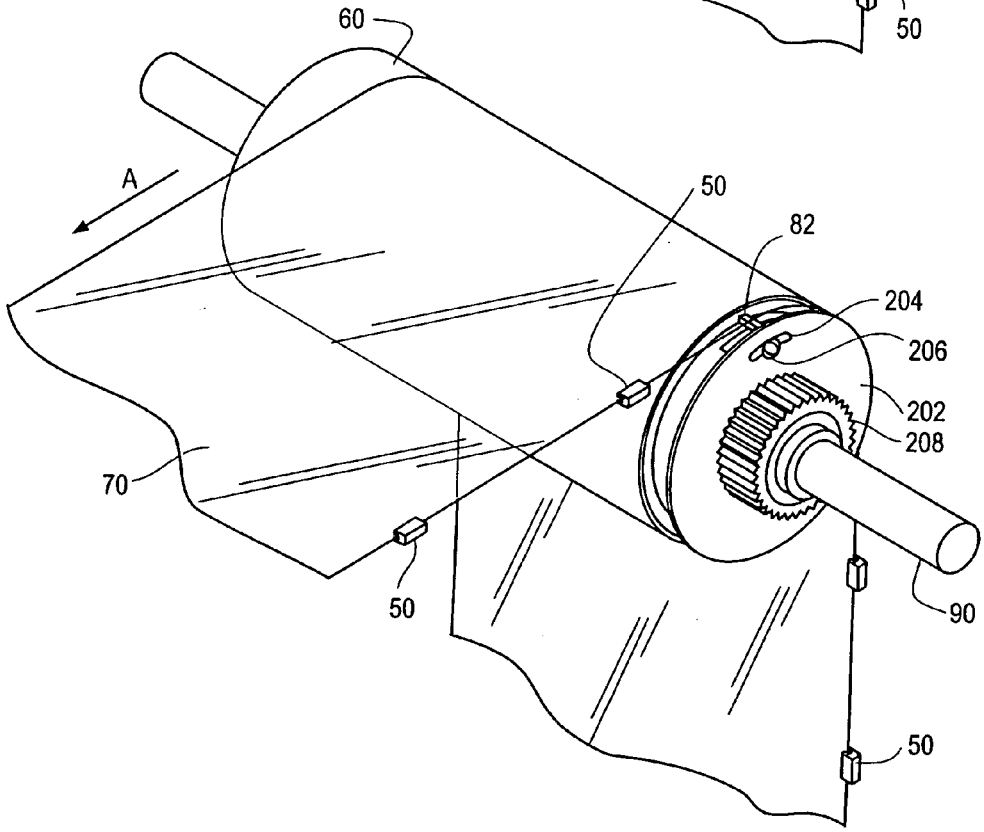
FIG. 2 is a perspective view of an apparatus according to a second embodiment of the present invention.

As shown in FIGS. 1 and 2, the embodiments depicted therein are directed to an apparatus for moving sliders 50 mounted on mating zipper elements (not shown) of a film 70, along the mating zipper elements and film 70. The apparatus includes a roller 60 and an arm/projection 80/82. The film moves along a film path in a direction indicated by arrow A in FIGS. 1 and 2. Being mounted on the film 70, the sliders 50 also move along the film path. The roller 60 supports the film 70 as it moves along the film path. Typically, the roller 60 rotates at the same rate of speed at which the film 70 moves. This may be achieved by mechanically driving the roller 60 and the film 70. Alternatively, the roller 60 may be powered and controlled separately from the movement of the film 70 so as to rotate at the proper speed.

The arm/projection 80/82 moves such that it intermittently comes into range of the film 70 so as to be contactable with the sliders 50 mounted thereon. Preferably, the arm/projection 80/82 comes into range of the sliders 50 at regularly spaced intervals. These intervals may be time controlled, but preferably are controlled based on the amount of rotation of the roller 60 (which should correspond to a set length of the film 70).

At each interval, the arm/projection 80/82 sweeps along a length of the film 70 so as to contact a slider 50 that may be positioned along the swept length. Accordingly, any slider 50 positioned along the intermittently spaced lengths of the film 70 are pushed along the mating zipper elements (and thus the film 70) for that length. At the end of the sweep of the arm/projection 80/82 along the length, the arm 80 moves out of range of the slider 50, leaving the slider 50 at a registered position along the film 70.

Figure 3:
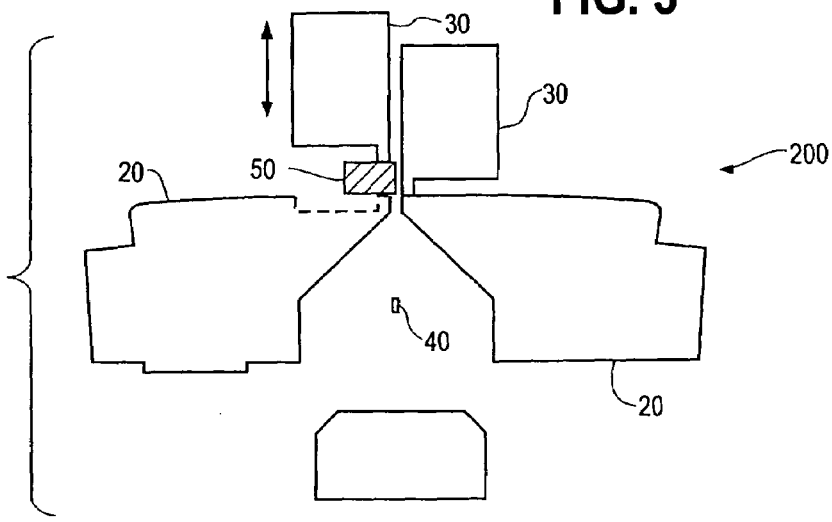
FIG. 3 is a side view of a severing and sealing device used in one stage of the manufacturing process in which an apparatus according to the present invention may be used.

By this operation, the arm/projection 80/82 serves to clear a specified length of the film 70 of any slider 50. Typically, each length of the film 70 cleared by the arm/projection 80/82 is a length at which a downstream manufacturing component acts on the film 70. For instance, each cleared length may correspond to an area of the film 70 at which the severing and sealing apparatus shown in FIG. 3 will clamp and sever the film. Thus, the present invention may serve to move any sliders 50 from areas of the film 70 which the severing and sealing apparatus is about to contact so that the sliders 50 do not interfere with the operation of the severing and sealing apparatus and/or damage the machinery of that apparatus.

Of course, the present invention may be used to move the sliders 50 so as not to interfere with other components of the manufacturing system, or for reasons not related to the protection of the machinery of the manufacturing system.

Preferred embodiments for achieving the above objects are set forth below. The following examples are merely illustrative of preferred designs of an apparatus according to the present invention. Other designs may be implemented while still keeping with the scope of this invention.

First Embodiment

FIGS. 1, 4A–5B, and 6 show an apparatus according to a first preferred embodiment of the invention.

As shown in FIG. 1, the roller 60 supports the film 70 as the film 70 moves along the film path, the direction of which is shown by arrow A. The film 70 is actually a folded web of thermoplastic film (the fold being parallel to the direction of movement). The sliders 50 open and close mating zipper elements (not shown) formed on opposing free ends of the film 70 by sliding along the mating zipper elements in directions parallel to arrow A. Accordingly, the sliders 50 are slidable along the film 70 both in and opposite to the direction of movement of the film 70.

In this embodiment, the roller 60 is cylindrical in shape and rotates about an axis that extends through the center of the circumference of the cylinder. The diameter of the cylinder is preferably in a range that is approximately 4 to 8 inches. The roller 60 may be made of materials such as aluminum or steel. As shown in FIG. 1, the axis is defined by a shaft 90 on which the roller 60 is mounted. As the film 70 moves along the film path, the roller 60 rotates about its axis at a rate of speed equal to the rate of speed of the film 70 along the film path.

The roller 60 may be powered by a motor 92. In that case, the speed of the roller 60 may be controlled by electronic or other timing mechanisms that control the operation of the motor 92. The roller 60 may also be an idler roller that is rotated by the force of the film 70 moving across the roller 60. The roller 60 may be secured to the shaft 90 such that the shaft rotates with the roller 60. Alternatively, the roller 60 may be supported on the shaft 90 by bearings (not shown) such that the roller 60 rotates about the shaft 90.

Figure 6:
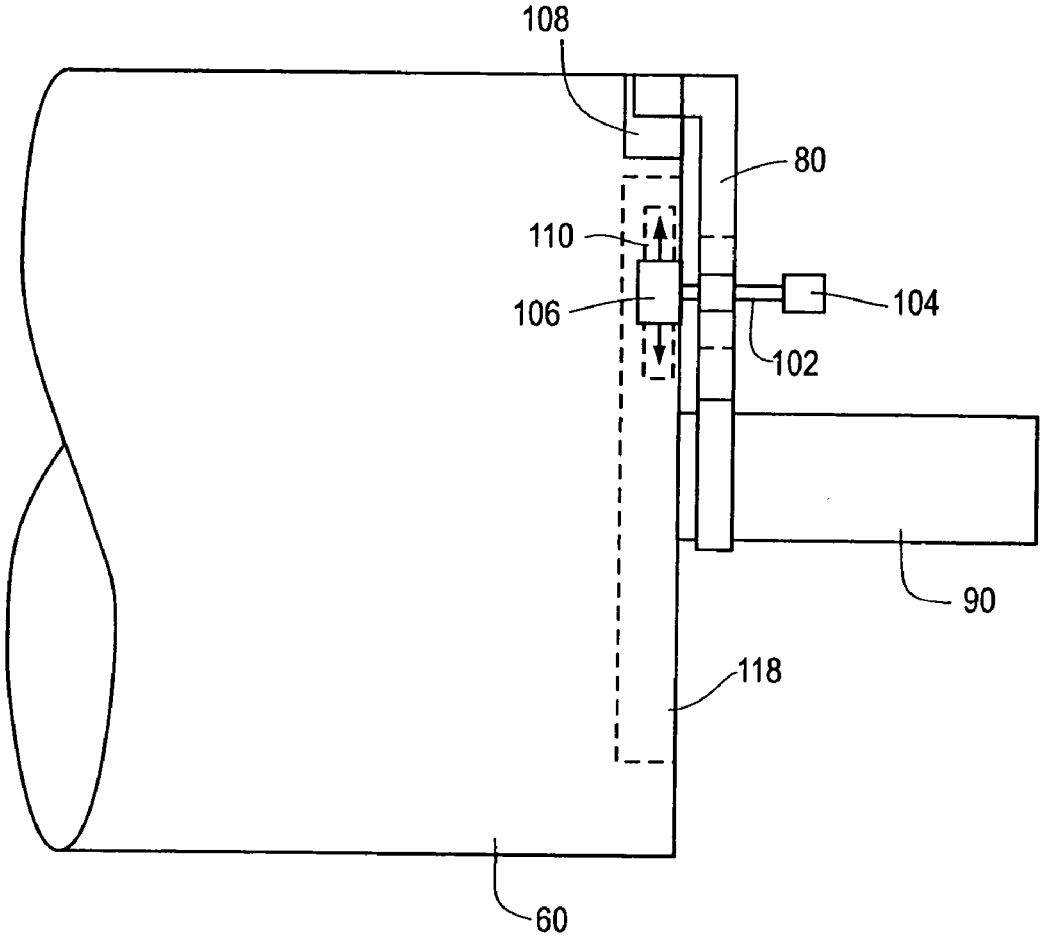
FIG. 6 is a front view of the first embodiment of the present invention.

Formed on the cylindrical face of the roller 60 is a depression 118. As shown in FIGS. 1 and 6, the depression 118 is formed on an edge of the cylindrical shape such that it forms a ledge that opens onto the face and a side of the cylinder. The depression 118 preferably extends along the circumference of the roller 60 for a distance in the range of approximately 1.5 to 5 inches. The width of the depression 118 is preferably at least as wide as a slider 50. The depth of the depression should be approximately half a thickness of the slider 50.

The specific measurements of the above items are formulated such that as the roller 60 rotates, the depression 118 converges with the sliders 50 which are intermittently spaced along the film 70. Preferably, the depression 118 is formed so as to couple lengths of the film where the sliders 50 are likely to be positioned such that the portion of the film 70 supporting a slider 50 is suspended across the depression 118. More preferably, the depression 118 couples both a length of the film 70 where the slider 50 should be positioned and an adjacent length of film where the slider 50 should not be positioned (i.e., a length of the film 70 on which the severing and sealing apparatus will contact).

Accordingly, the length of the depression 118 and the circumference (or size) of the roller 60 may be varied to accommodate the needs of different manufacturing lines (i.e., lines for making differently sized bags).

Also as shown in FIGS. 1 and 6, the apparatus includes an L-shaped arm 80, which is preferably made of a material such as aluminum, steel, or any other metal or composite plastic. The arm 80 is rotatably mounted on the shaft 90. Preferably, the arm 80 is mounted on bearings (not shown). A portion of the arm 80 is positioned within the depression 118. Accordingly, the arm 80 is rotatable about the shaft 90 and movable within the depression 118. It is preferred that the movement of the arm 80 be controlled and actuated by the rotation of the roller 60 (as will be described in more detail below).

Figure 5A:
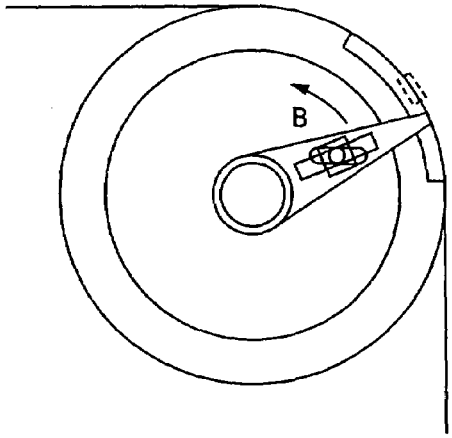
FIGS. 5A and 5B are also side views of the first embodiment of the present invention in use.
Figure 5B:
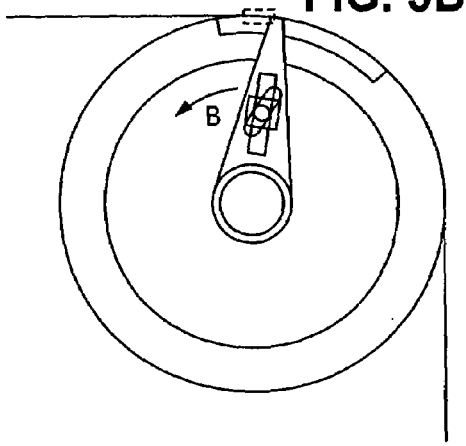

In this embodiment, once the depression 118 has moved into position such that it supports the length of the film 70 containing the corresponding slider 50, the portion of the arm 80 positioned in the depression 118 moves along the depression 118 as the roller 60 rotates and the film 70 moves along the film path. At least for a portion of one rotation in which the depression 118 suspends the length of the film 70 containing the slider 50, the arm 80 rotates at a faster rate than the roller 60 (and the film 70) so that it can contact and push the slider 50, as shown in FIGS. 5A and 5B. In FIG. 5A, the arm 80 moves in the direction of arrow B (with respect to the roller 60) to come into contact with the slider 50 suspended in the depression 118. In FIG. 5B, the arm 80 has pushed the slider 50 to the intended position, prior to the length of the film supporting the slider 50 coming out of contact with the roller 60. Preferably, the projection is contactable with the slider 50 along a length of the film in the range of about 0.75 inch to about 2.0 inches.

In other embodiments, the arm 80 may be slower that the roller 60 for a portion of the rotation so that the arm 80 inhibits the movement of the slider 50 in the film path, thus moving it in the opposite direction as that shown in FIGS. 5A and 5B.

Figure 4A:
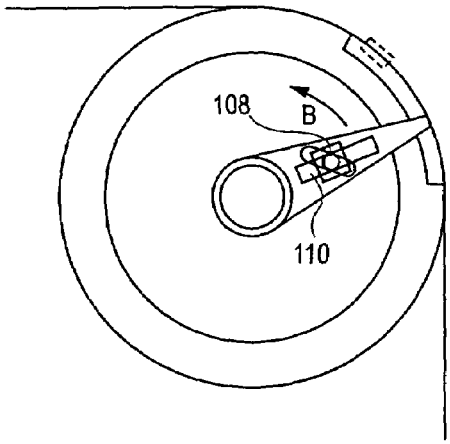
FIGS. 4A and 4B are side views of the first embodiment of the present invention in use.
Figure 4B:
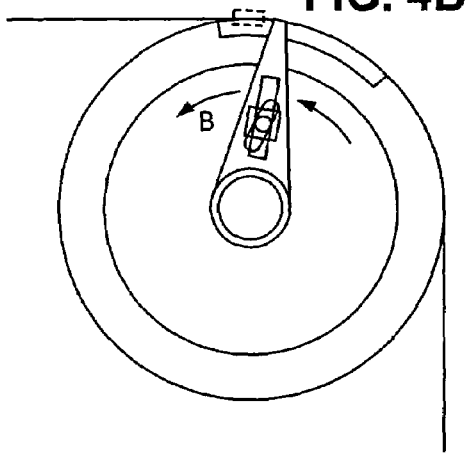

FIGS. 4A and 4B show an example in which the slider 50 is already correctly positioned, in which case, the arm 80 does not come into contact with it as the arm 80 sweeps across the depression 118.

The mechanisms for controlling the operation of the arm 80 may vary; however, in the embodiment shown in FIGS. 1 and 6, a cam follower mechanism is used to control the operation, as described in detail below.

The apparatus shown in FIGS. 1 and 6 includes a cam follower 102 follower, having a cam head 104 and a cam base 106, and a cam track 112 formed in a cam member 114. The cam follower 102 is mounted on a side of the roller 60 such that the cam base 106 is slidably secured in a roller slot 110. The roller slot 110 extends in a direction substantially perpendicular to the shaft 90. Accordingly, the cam follower 102 is secured in and movable along the roller slot 110.

When fully assembled, the cam head 104 is positioned in the cam track 112 of the cam member 114. The cam member is preferably secured in the apparatus such that the cam track 112 is stationary. As the roller 60 rotates, the cam head 104 moves along the cam track 112. The profile of the cam track 112 actuates the cam follower 102 so as to move within the roller slot 110. Thus, depending on the shape of the cam track 112 and the position of the cam follower 102 along the cam track 112, the cam base 106 may be at various positions within the roller slot 110.

As shown in FIG. 6, the cam follower 102 extends through the arm 80 so as to be positioned in an arm slot 108. Thus positioned, the cam follower 102 biases the arm 80 around the shaft as the roller 60 rotates. As shown in FIG. 4A, the arm slot 108 extends along a diagonal of the roller slot 110. As the cam follower 102 moves along the roller slot 110, the cam follower 102 also moves along the arm slot 108. By moving in a direction slightly offset from the extending direction of the arm slot 108, the cam follower 102 controls the position of the arm 80 with respect to the roller 60 as the cam follower 102 moves within the roller slot 110.

Thus, the shape of the cam track 112 actuates the cam follower 102 along the roller slot 110 as the roller 60 rotates, which in turn controls the movement of the arm 80. As shown in FIG. 4A, the cam track 112 is shaped such that the portion of the arm 80 positioned in the depression 118 is positioned at one end of the depression 118 when the slider 50 is first suspended within the depression 118. As the rotation continues, the path of the cam track 112 causes the cam follower 102 to move along the roller slot 110 toward the depression 118. As the cam follower 102 moves in this direction, the arm 80 moves along the depression 118 from the position shown in FIG. 4A to the position shown in FIG. 4B. Once the slider 50 is out of position of the depression 118 (and the roller 60 continues to rotate), the path of the cam track 112 causes the arm 80 to be repositioned at the beginning of the depression 118 for another pass along the film 70.

Figure 7:
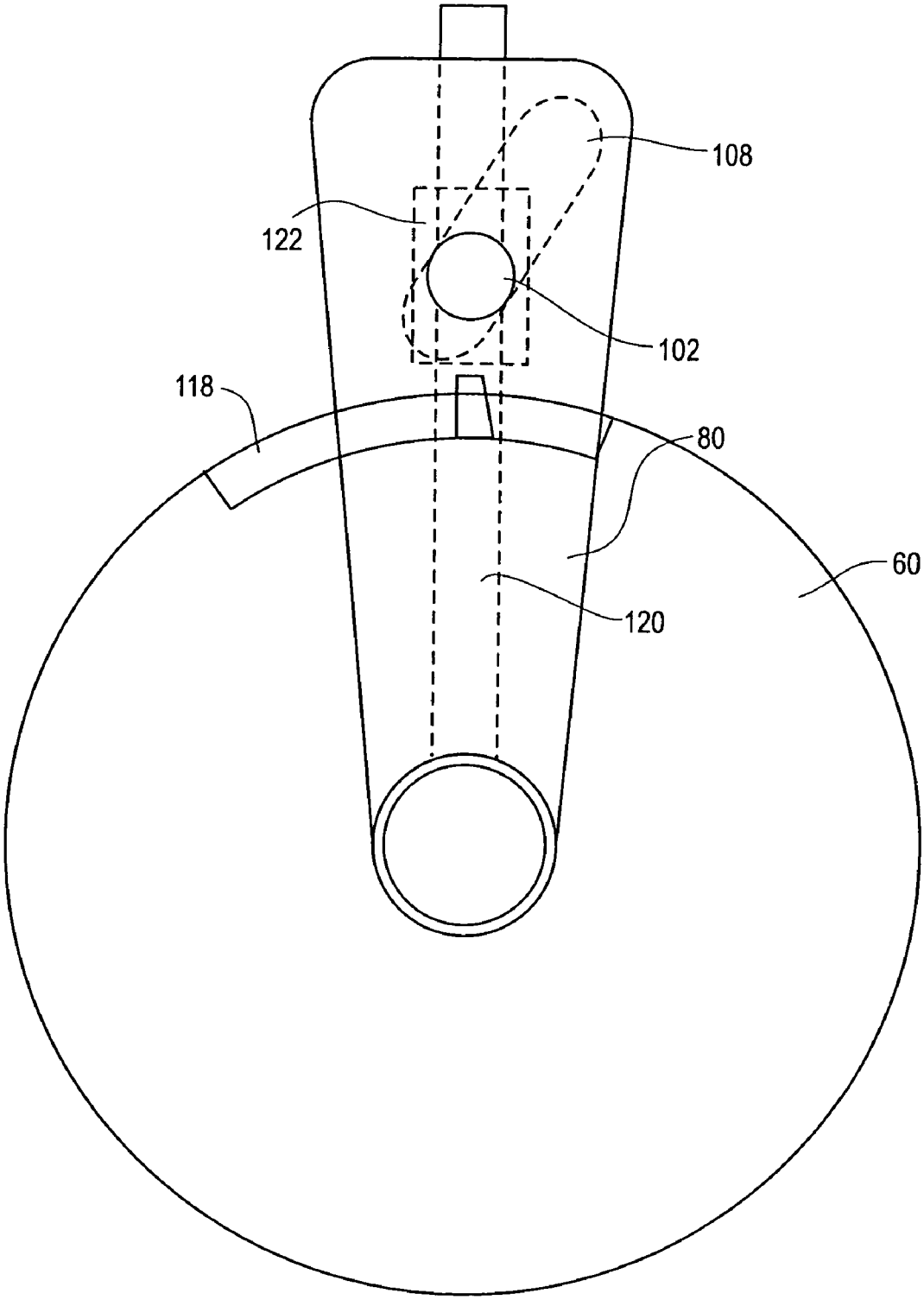
FIG. 7 is a side view of an apparatus according to a variation of the first embodiment of the present invention.
Figure 8:
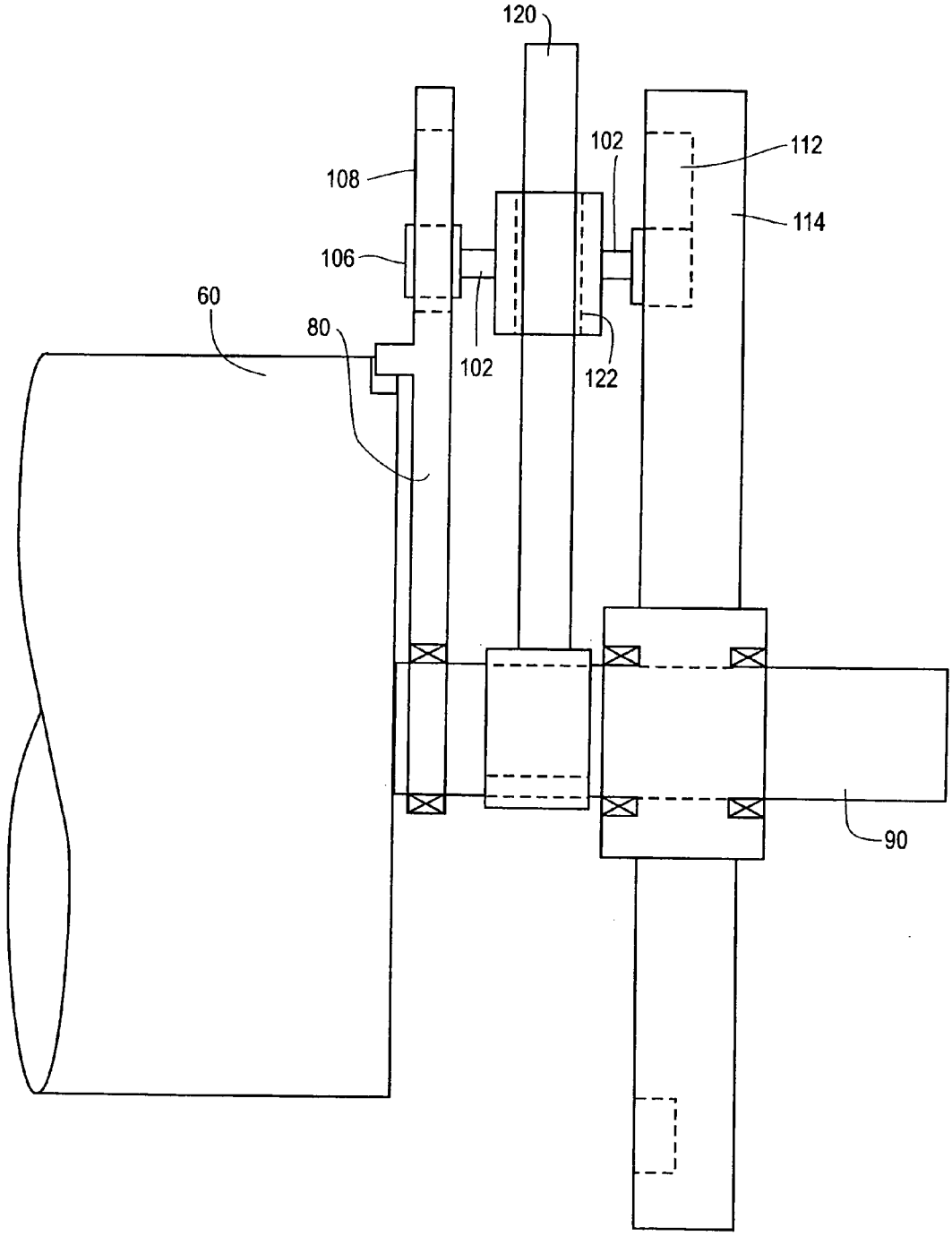
FIG. 8 is a front view of the apparatus shown in FIG. 7.

FIGS. 7 and 8 shows a slightly different arrangement of an apparatus according to the first embodiment. In this arrangement, the cam follower 102 is not positioned within the roller slot 110, but is arranged peripherally to the roller 60. This arrangement is useful when the roller 60 is of a small size that makes it difficult to arrange the cam follower 102 and cam track 112 along the side of the roller 60.

As shown in FIG. 8, the cam follower 102 is slidably secured on a cam arm 120. The cam arm 120 is secured to the shaft 90 such that is rotatable in a plane parallel to the plane of rotation of the roller 60. Preferably, the cam arm 120 and roller 60 are secured to the shaft 90 so as to rotate therewith.

The cam base 106 is positioned within the arm slot 108 so that the cam follower 102 actuates the arm 80 in a manner similar to that described above, as the cam arm 120 rotates with the shaft 90 and roller 60. However, in this arrangement the arm slot 108 is positioned on a far side of the depression 118 with respect to the shaft 90.

Also as shown in FIGS. 7 and 8, the cam head 104 is positioned in the cam track 112, which is peripheral to the roller 60. Accordingly, as the cam arm 120 rotates, the cam head 104 moves in the cam track 112. The profile of the cam track 112 actuates the cam follower 102 so as to move along the cam arm 120 in directions perpendicular to the shaft 90. In turn, the cam base 106 moves within the arm slot 108, which moves the arm 80 with respect to the depression 118.

Second Embodiment

FIG. 2 shows an apparatus according to a second embodiment of the invention.

As shown in FIG. 2, the roller 60 supports the film 70 as the film 70 moves along the film path in the direction of arrow A. The movement, control, and specifications of the roller 60 are similar to those set forth above with respect to the first embodiment. In addition, the shaft may serve the same function and operate in the same manner as described above.

However, in the second embodiment, a projection 82 is used in the place of the arm 80. The projection 82 performs the same function as the arm 80 in that it intermittently comes into range of the film 70 to be contactable with sliders 50 positioned along the film 70, and sweeps across predetermined lengths of the film 70 to clear the sliders 50 along those lengths. The projection is preferably formed of a material such as aluminum or steel.

As shown in FIG. 2, the projection is mounted on an outer circumference of a disc 202 which is rotatably mounted on the shaft 90. The projection 82 is slidably secured to the disc 202 such that the projection 82 is movable along a portion of the circumference of the disc 202. The position of the projection 82 along the circumference of the disc 202 is controlled by a phase adjuster 206. The phase adjuster 206 is secured to the projection 82 and is positioned in a disc slot 204 extending through a side of the disc 202 (behind which the projection 82 is mounted). The portion of the phase adjuster 206 extending through the disc slot 204 may be secured within the disc slot 204 to fix the projection 82 along the disc 202. The phase adjuster 206 may be secured within the disc slot 204 using any one of a number of known fasteners such that an operator may unfasten the phase adjuster 206 from the set position in the disc slot 204 and adjust the position of the projection 82 along the disc 202.

Preferably, the portion of the disc 202 on which the projection 82 is mounted has a smaller diameter than the roller 60, as shown in FIG. 2. We also prefer that the film 70 move across the roller 60 such that an edge portion including the sliders 50 hangs over the side of the roller 60 so as to be suspended above the portion of the disc 202 including the projection 82. In this way, the projection 82 may come into contact with a slider 50 as it is suspended in the film path, in much the same way as the arm 80 contacts a slider 50 suspended in the depression 118, as discussed above.

The disc 202 rotates at a different rate than the roller 60. Preferably, the disc 202 rotates at a factor faster than the roller 60 (e.g., two times). However, the rotation of the projection 82 may be slower than that of the roller 60, as discussed above with respect to the arm 80. In addition, the rotational speed of the projection 82 in one rotation may be variable so as properly to sweep across the predetermined length.

The rotation is controlled such that the projection 82 intermittently comes into proximity to the film 70 (preferably at regularly spaced intervals) so as to sweep across a predetermined length of the film 70 and push any sliders 50 located along that length to a registered position.

Most preferably, the rotation of the disc 202 is controlled by the rotation of the roller 60. This may be accomplished by mechanically connecting the disc 202 and roller 60 by means of a timing belt, gear system (a gear 208 is shown in FIG. 2 for such a purpose), or other conventional system. Alternatively, the disc 202 may be separately controlled by means of a motor and electronic or other such timer (not shown). The phase adjuster 206 may be moved to adjust the projection 82 to correct any mis-positioning of the projection 82 with respect to the film 70.

Similar to the first embodiment, the specifications of the disc 202 and the roller 60 may be altered to accommodate different manufacturing lines in which the sliders 50 may be spaced from each other at different intervals. In addition, the speed of rotation of the disc 202 may be set in any number of ways to most accurately clear sliders 50 from regularly spaced lengths of the film 70.

The embodiments discussed above are representative of embodiments of the present invention and are provided for illustrative purposes only. They are not intended to limit the scope of the present invention. Although components, configurations, sizes, times, etc., have been shown and described, such are not limiting. Modifications and variations are contemplated within the scope of the present invention, which is intended only to be limited only by the scope of the accompanying claims.

INDUSTRIAL APPLICABILITY

The apparatus and method of the present invention are suited for use in moving a slider for operating mating zipper elements along the mating zipper elements during the manufacture of a product that includes mating zipper elements operated by a slider. In order to prevent damage to the slider and manufacturing machinery, the apparatus and method are used to move the slider out of the way of machinery operating on the product being manufactured. In particular, an arm sweeps across the mating zipper elements to push the slider therealong to clear a predetermined length of the mating zipper elements.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A manufacturing apparatus for moving sliders for opening and closing mating zipper elements along the mating zipper elements, said apparatus comprising:

a roller rotating about an axis substantially perpendicular with a path of a film including the mating zipper elements and contacting the film as the film moves in the film path at a speed equal to the speed of rotation of said roller; and a projection rotating about an axis at a speed different than the rotational speed of said roller, said projection rotating into proximity to the moving film along predetermined lengths of the film so as to be contactable with sliders mounted thereon, wherein said projection comes into contact with sliders positioned along the mating zipper elements of the predetermined lengths of film and pushes those sliders along the mating zipper elements to respective registered positions, and wherein said roller includes a depression formed in an outer surface thereof and a portion of said projection is positioned in the depression.

2. The apparatus according to claim 1, wherein the axis of rotation of said projection is substantially parallel with the axis of rotation of said roller.

3. The apparatus according to claim 2, wherein said roller is cylindrical and the axis of rotation of said roller extends along the center of the circumference of said roller.

4. The apparatus according to claim 3, wherein said roller is driven by a motor.

5. The apparatus according to claim 2, wherein said roller is cylindrical and the axis of rotation of said roller extends along the center of the circumference of said roller.

6. The apparatus according to claim 5, wherein the depression is formed at an edge of an outer face of said cylindrical roller.

7. The apparatus according to claim 6, wherein the rotation of said roller is timed such that one of the sliders moving in the film path is positioned within the depression as a lateral section of the film on which the slider is mounted moves across said roller.

8. The apparatus according to claim 7, wherein said projection moves within the depression to push the slider along the mating zipper elements to the registered position.

9. The apparatus according to claim 8, wherein the rotation of said roller actuates said projection in its path of rotation.

10. The apparatus according to claim 9, further comprising:

a cam mounted on a side of said roller and movable in directions substantially perpendicular to the axis of rotation of said roller; and a stationary cam track in which a free end of said cam is positioned and which actuates said cam as said roller rotates, said projection comprising an opening through which said cam projects, said cam actuating said projection to move within the depression as said cam travels along said stationary cam track.

11. A method of moving sliders for opening and closing mating zipper elements along the mating zipper elements during the manufacture of products including mating zipper elements operated by a slider, said method comprising the steps of:

supporting a film containing the mating zipper elements on a roller rotating about an axis substantially perpendicular with a path of the film as the film moves in the film path at a speed equal to the speed of rotation of the roller;

intermittently moving a projection into proximity to the mating zipper elements along predetermined lengths of the mating zipper elements so as to be contactable with sliders mounted thereon, wherein the projection rotates about an axis at a speed different than the rotational speed of the roller; and pushing the sliders, which are positioned along the predetermined lengths of the mating zipper elements, with the projection along the mating zipper elements to respective registered positions, wherein in said supporting step the rotation of the roller is timed such that, in one rotation, one of the sliders is suspended within a depression on the face of the roller as the roller is rotated and the slider moves along the film path, and in said pushing step the slider is pushed by the projection while it is suspended in the depression.

12. The method according to claim 11, wherein in said moving step the projection rotates about an axis substantially parallel with the axis of rotation of the roller and, for at least a portion of one rotation, at a speed different than the rotational speed of the roller.

13. The method according to claim 12, wherein in said supporting step the roller is driven by a motor.

14. The method according to claim 12, wherein in said supporting step the rotation of the roller actuates the projection in its path of rotation.

* * * * *